US006748879B2

(12) United States Patent
Ehrmann et al.

(10) Patent No.: US 6,748,879 B2
(45) Date of Patent: Jun. 15, 2004

(54) GOODS TRANSFER STATION AND PROCESS FOR OPERATING SUCH A GOODS TRANSFER STATION

(75) Inventors: Albrecht Ehrmann, Grenchen (CH); Lorenz Gilomen, Lengnau (CH)

(73) Assignee: Dock-1 AG, Lengnau (CH)

( * ) Notice: Subject to any disclaimer, the term of this patent is extended or adjusted under 35 U.S.C. 154(b) by 0 days.

(21) Appl. No.: 10/214,321

(22) Filed: Aug. 8, 2002

(65) Prior Publication Data

US 2003/0029695 A1 Feb. 13, 2003

(30) Foreign Application Priority Data

Aug. 8, 2001 (EP) ..... 01810765

(51) Int. Cl.[7] ..... E06B 7/32

(52) U.S. Cl. ..... 109/19; 109/13; 109/48; 109/71; 109/73

(58) Field of Search ..... 109/19, 10–13, 109/17, 48, 49, 53–57, 71, 73; 232/43.1–43.4, 44; 312/238, 299, 305, 139

(56) References Cited

U.S. PATENT DOCUMENTS

| | | | | | |
|---|---|---|---|---|---|
| 575,705 | A | * | 1/1897 | Damon | 109/71 |
| 2,378,284 | A | | 6/1945 | Burge | 194/294 |
| 2,480,685 | A | * | 8/1949 | Adams | 232/44 |
| 3,031,133 | A | * | 4/1962 | Jones | 232/44 |
| 3,474,745 | A | * | 10/1969 | Schlaefi | 109/19 |
| 3,702,101 | A | * | 11/1972 | Moore | 109/19 |
| 4,351,247 | A | * | 9/1982 | Clark | 109/19 |
| 4,540,106 | A | * | 9/1985 | Fukatsu | 221/13 |
| 4,637,325 | A | | 1/1987 | Hong | 119/75 |

FOREIGN PATENT DOCUMENTS

| | | | | |
|---|---|---|---|---|
| DE | 1708481 | * | 7/1970 | 109/19 |
| DE | 85 09 298 U1 | | 5/1985 | |
| GB | 322 088 A | | 11/1929 | |
| GB | 1184923 | * | 3/1970 | 109/19 |
| WO | WO 01 16904 A | | 3/2001 | |

* cited by examiner

*Primary Examiner*—John B. Walsh
(74) *Attorney, Agent, or Firm*—Oliff & Berridge, PLC

(57) ABSTRACT

The invention relates to a goods transfer station (1) for discharging articles (4, 5), having at least one delivery window (12), at least one conveying space (19, 20, 21, 22, 30, 31) and at least one closing element (23, 24, 25, 26, 32, 33), it being the case that the conveying space has at least one opening (9, 10), through which an article (4, 5) can be discharged from the conveying space (19, 20, 21, 22, 30, 31), that the conveying space (19, 20, 21, 22, 30, 31) can be moved between at least one unloading position (7) and at least one loading position (3), that its opening (9, 10) is located in the region of a delivery window (12) in the unloading position (7), and that the opening can be closed by the closing element at least in the unloading position. The invention also relates to a process for operating such an apparatus.

23 Claims, 10 Drawing Sheets

6

GOODS TRANSFER STATION AND PROCESS FOR OPERATING SUCH A GOODS TRANSFER STATION

BACKGROUND OF THE INVENTION

1. Field of Invention

The invention relates to a goods transfer station and to a process for operating such a goods transfer station according to claims 1 and 13, respectively.

2. Description of Related Art

Goods transfer stations for the controlled delivery of goods are important, in particular, in the case of vending machines. The operations of selling and delivering goods by a vending machine take place automatically and are thus not monitored by operators. The problem here is to transfer ordered goods to the customer from a storage region which is not freely accessible, but to prevent possible access to the supplies of goods which have not been purchased.

DE 23 45 177 describes a transfer station for the automatic delivery of goods, in particular bottle crates. The transfer station has a transfer-station channel, which can be closed on both sides by doors. During the operation of discharging goods, in each case one of the doors is closed. The known transfer station has various disadvantages. The separating device and the transfer principle are not suitable for a wide range of goods both of different sizes and with different packaging. There are risks to the user of getting something trapped. Finally, it is possible to access the transfer space and, through the transfer-station channel, the goods magazine from the outside.

The delivery apparatus described in DE 36 06 268 is designed for a goods-containing shaft. The basic principle is only suitable for goods of standard size and with standard packaging. The locking of the delivery opening is relatively complicated and thus susceptible to malfunctioning and possibly vandalism.

In addition, as from a certain size of goods, more stringent requirements have to be met by the transfer station, because the delivery opening is large enough for people or animals to pass through it. This is the case, for example, with an automatic beverage terminal according to WO 96/07993, at which beverage crates are delivered.

International Patent Application No. PCT/CH01/00132, which was not published before the priority date, describes a goods transfer station which, with improved resistance to misuse and operational reliability, can discharge goods of different types, sizes and shapes. In addition to the transfer-station channel, which has an inlet opening and a closeable outlet opening, said goods transfer station has a closing element, which can be introduced into the transfer-station channel and can be moved to the outlet opening. When the outlet opening is open, the closing element separates the inlet section of the transfer-station channel between the closing element and inlet opening from the outlet section of the transfer-station channel between the closing element and outlet opening such that the transfer-station channel is blocked and it is more difficult to act on the inlet section from the outside. The flow of goods through the transfer station takes place exclusively from the inlet opening to the outlet opening. The article here is conveyed to the outlet opening by a conveying mechanism, which may also be realized by the closing element.

SUMMARY OF THE INVENTION

The problem here is the relatively long duration of a discharging cycle. A further article can only be introduced in front of the transfer-station inlet and into the transfer-station channel when the latter has been completely emptied.

The object of the invention is thus to make available a goods transfer station and a process for operating the same, by means of which all types of articles, in particular even voluminous or fragile goods, can easily and quickly be delivered in a controlled manner. The intention here is for the process to proceed without any risk to the user (handling safety) as well as easily, quickly and reliably (operational reliability) and for opportunities for the storage region to be subjected to action from the outside to be reduced, in particular for penetration into the storage region to be prevented (resistance to misuse).

This object is achieved by a goods transfer station having the features of claim 1 and by an operating process having the features of claim 13. Advantageous developments of the apparatus according to the invention and of the process are specified in the dependent claims, the description and the drawings.

The goods transfer station according to the invention comprises at least one delivery window and at least one conveying space, preferably, in order to increase the cycle frequency, two or more conveying spaces. The delivery window is located in a wall by means of which the storage region which is to be safeguarded is separated from the usually public delivery region. According to the invention, the conveying space can be moved between a loading position and an unloading position. The conveying space has at least one opening which, for the discharging operation, is moved into the region of a delivery window (unloading position). Said opening can be preferably largely completely closed by a closing element and is closed following the discharging operation and prior to the conveying space being moved away. This reduces the risk of someone being able to reach into the conveying space from the outside and of the user being injured as the conveying space moves away. An article is ejected again through the opening by means of a suitable conveying mechanism, the closing element then largely completely closing the opening. The closing element preferably constitutes a moveable wall of the conveying space, e.g., the rear wall, located opposite the opening, of said conveying space. During the discharging operation, the volume of the conveying space is gradually reduced, in order to prevent articles from remaining in the conveying space or from penetrating into the conveying space. The closing element, for this purpose, can preferably be moved in a direction essentially perpendicular to the opening, e.g., in the longitudinal direction of a conveying space configured as a conveying channel. For the ejecting operation, use is made of a conveying mechanism, e.g., a conveying belt on the base of the conveying space. Said conveying mechanism may also be formed by the closing element itself which, for example, ejects the article. The article is preferably introduced into the conveying space and discharged through the same opening. It is possible for the closing element to be assigned directly to the conveying space, e.g., to be formed by a displaceable rear wall, or to be capable of serving a plurality of conveying spaces. According to the invention, the conveying spaces can be moved between an unloading position and a loading position, their opening being located in the region of the delivery window in the unloading position. It is also possible for intermediate positions to be assumed. Different conveying spaces may have the same or different loading positions. In the unloading position, the closing element engages in the conveying space and closes the opening of the latter following the unloading operation. The conveying spaces preferably move horizontally between the loading and the unloading positions since, in this case, no weight-related forces have to be overcome. It is particularly preferable for the at least one conveying space to be rotated between the different positions. For this purpose, it may be arranged on or in a rotary body which is rotated about a preferably vertical axis.

The process according to the invention for operating such a goods transfer station provides that a conveying space is positioned in the region of a loading position and loaded there with at least one article, and then is moved into an unloading position, where the at least one article is ejected from the conveying space for example by means of the closing element or an additional conveying mechanism for unloading purposes. A plurality of conveying spaces are preferably provided and are moved synchronously. For example, one conveying space is displaced from the delivery window to the loading station and the other conveying space is displaced from the loading station to the delivery window, in particular by way of a rotary movement by a common drive. However, it is also possible to proceed asynchronously, this necessitating somewhat higher control-related and drive-related outlay.

The goods transfer station according to the invention and the process according to the invention for delivering articles in a penetration-resistant manner provide a possible technical solution for the cases where a wide range of different, in particular even voluminous, articles are to be delivered in a controlled manner from a closed-off or not freely accessible region, but penetration and access possibilities are to be prevented at the same time. The problem is relevant primarily, but not exclusively, in the case of vending machines. The operations of selling and delivering articles by a vending machine or a similar apparatus take place automatically and are not monitored by operators. It is also conceivable, however, to install the goods transfer station at manned delivery terminals.

BRIEF DESCRIPTION OF THE DRAWINGS

Examples of the invention are described hereinbelow and illustrated in the drawings, in which, purely schematically.

DETAILED DESCRIPTION OF PREFERRED EMBODIMENTS

Figure 1:
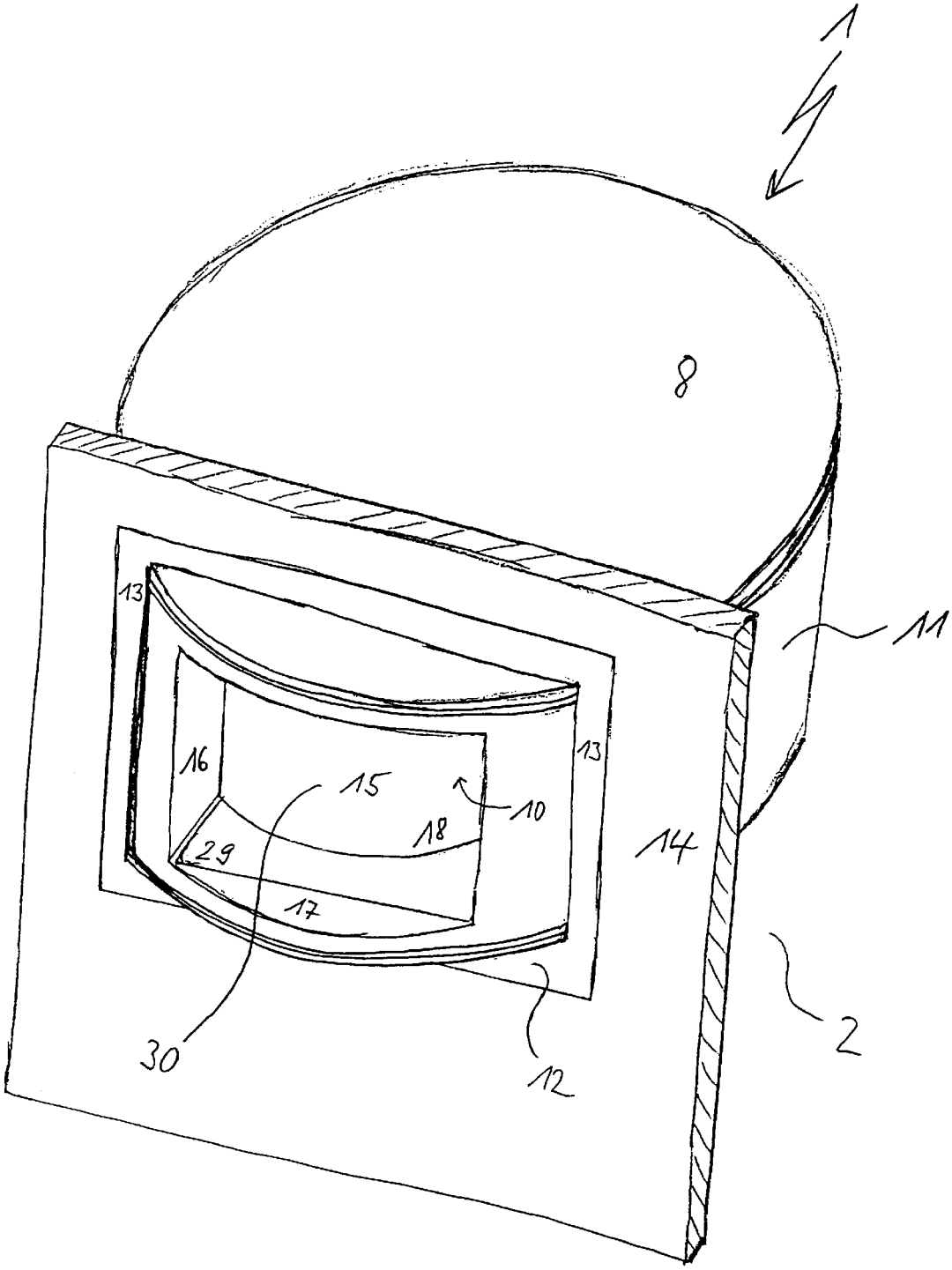
FIG. 1 shows a three-dimensional view of a goods transfer station according to the invention with a delivery window installed in a cut-away wall.

FIG. 1 shows a three-dimensional view of a goods transfer station 1, and FIGS. 2 to 9 show sectional views of the same goods transfer station 1 in different positions during the operations of introducing and/or discharging articles 4.

The goods transfer station 1 forms the connecting element between a protected or closed-off, inner region 2, i.e. one which is not accessible to the customers or recipients or purchasers of articles which are to be delivered, and an outer region 6, which is freely accessible to the customers or recipients or purchasers. The two regions are separated by a partition wall 14, which has a delivery window 12 in the region of a transfer location 7 for the goods which are to be discharged. Located in the inner region 2 is at least one loading position 3, at which articles 4, 5 which are to be discharged are transferred to the goods transfer station 1. They are moved into the loading position 3, for example, by a belt conveyor (not shown here).

The goods transfer station 1 has a wheel-like rotary body 8 with a continuous, horizontally running, cross-sectionally rectangular transfer-station channel 15, of which the ends form conveying spaces 30, 31. The axis of the rotary body 8 runs vertically. The rotary body may also be designed in some other way, as is illustrated by way of example in FIG. 10. The two mutually opposite openings 9, 10 of the transfer-station channel 15 each serve for introducing articles into the associated conveying space 30, 31 and for discharging the same from the associated conveying space.

With the exception of the openings 9, 10, the rotary body 8 comprises a continuous lateral surface area 11, which projects, in part, through the delivery window 12. The delivery window 12 is provided laterally with strippers 13. The transfer-station channel 15 runs through the center of the rotary body 8. Its lateral boundary is formed by surfaces 16, 17. Located in the transfer-station channel 15 is a piston element 18, which can be displaced horizontally in the transfer-station channel 15 by means of a suitable drive (not shown here). The piston element 18 has the function of blocking the transfer-station channel 15 permanently, but at variable positions, and thus of releasing the conveying spaces 30, 31 for accommodating an article, or of closing off said conveying spaces in the outward direction, and, if appropriate, of ejecting the article. The two sides of the piston element 18 arranged in the channel direction have the function of closing elements 32, 33. They serve for closing the opening 9, 10 following the operation of unloading an article at the unloading position 7, and during the subsequent operation of rotating the opening 9, 10 away, and thus for preventing articles from passing out of the outer region 6 into the goods transfer station 1 or preventing the user being injured as the opening rotates away. The transfer-station channel 15 is not released throughout. In the simplest variant, the piston element 18 separates the transfer-station channel into two conveying spaces 30, 31 which, in dependence on the position of the piston element, may have a volume in each case of from 0 to 100 percent of the transfer-station channel minus the space required by the piston element 18. The sides which are directed toward the openings 9, 10 and function as closing elements 32, 33 are curved in accordance with the radius of the rotary body in order to close as well as possible the openings in the lateral surface 11 of the rotary body 8.

The length of the piston element 18 is slightly greater than the radius of the rotary body 8. This has the advantage that the piston element 18 can be moved by a single drive arranged in a protected manner within the piston element 18 in the region of the center of rotation, as a result of which, inter alia, the handling safety and operation reliability are increased. The drive comprises, for example, a gearwheel which engages in a rack rail integrated in the piston element 18. In another variant (not shown), the piston element is as narrow as possible. This has the advantage, in the case of a rotary body with a given radius, of a larger conveying space being formed.

The partition wall 14 has protective walls 36 which, extending laterally from the delivery window 12, fit closely against the lateral surface 11 of the rotary body. This essentially wedge-like or circle-arc-segment-like shape of the protective walls 36 avoids the risk of injury, during rotation of the rotary body, which otherwise exists when one reaches through the delivery window.

Figure 3:
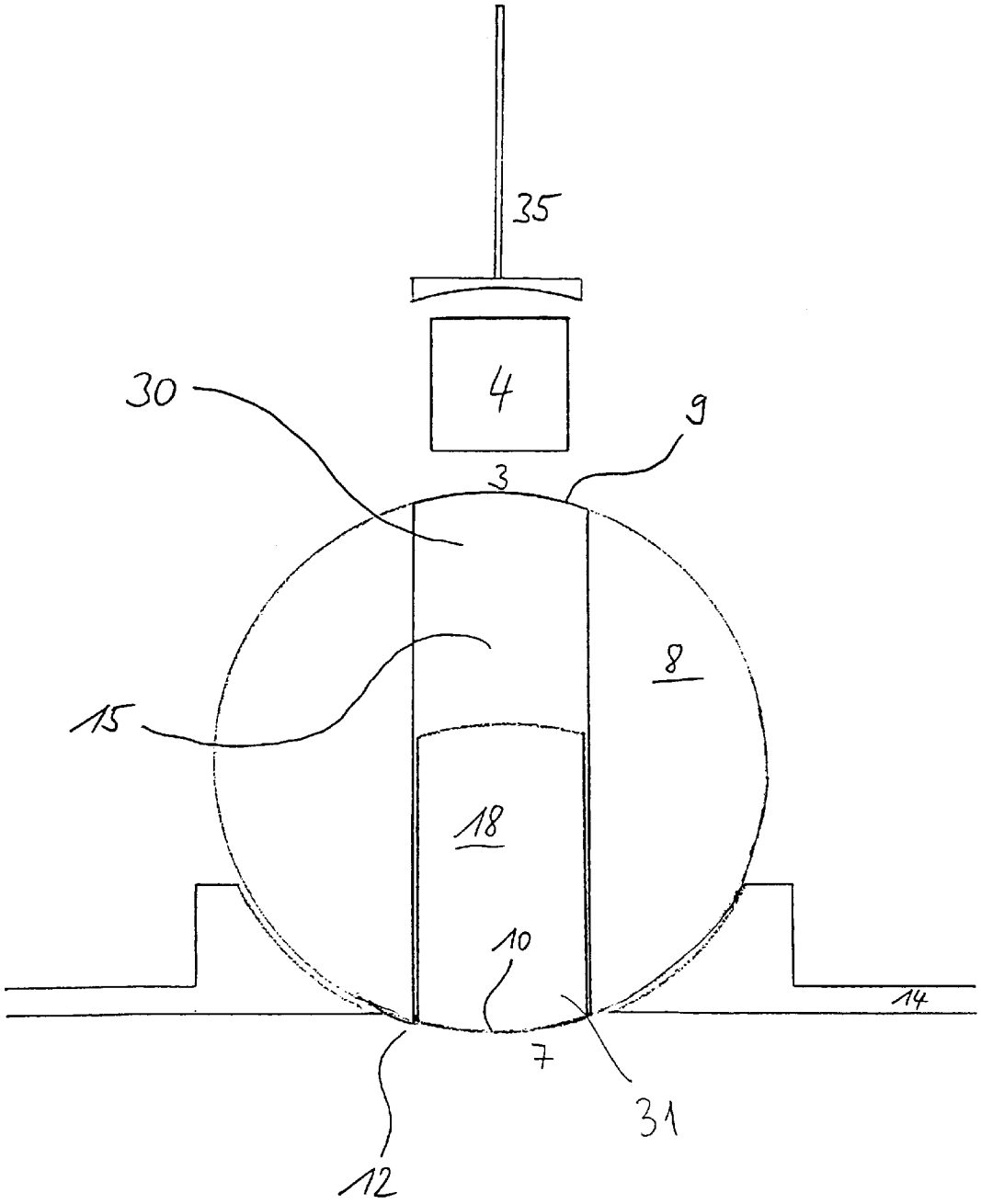
FIG. 3 shows a section through the goods transfer station according to FIG. 2 in the standby position.

The goods transfer station 1 according to the invention is preferably operated as follows: in the standby position (FIG. 3), one of the conveying spaces 30 is located at the loading position 3 and the opposite conveying space is located at the unloading position 7. In the example shown, the conveying space 31 is completely filled by the piston element 18; its opening 10 is closed. It is also possible, however, for the piston element 18 to close the opposite opening 9 and to release the conveying space 31 in its entirety. The position shown in FIG. 3 is expedient, in particular, when the article 4 which is to be introduced is moved in the channel direction by a conveying mechanism which is independent of the drive of the piston element 18.

Figure 4:
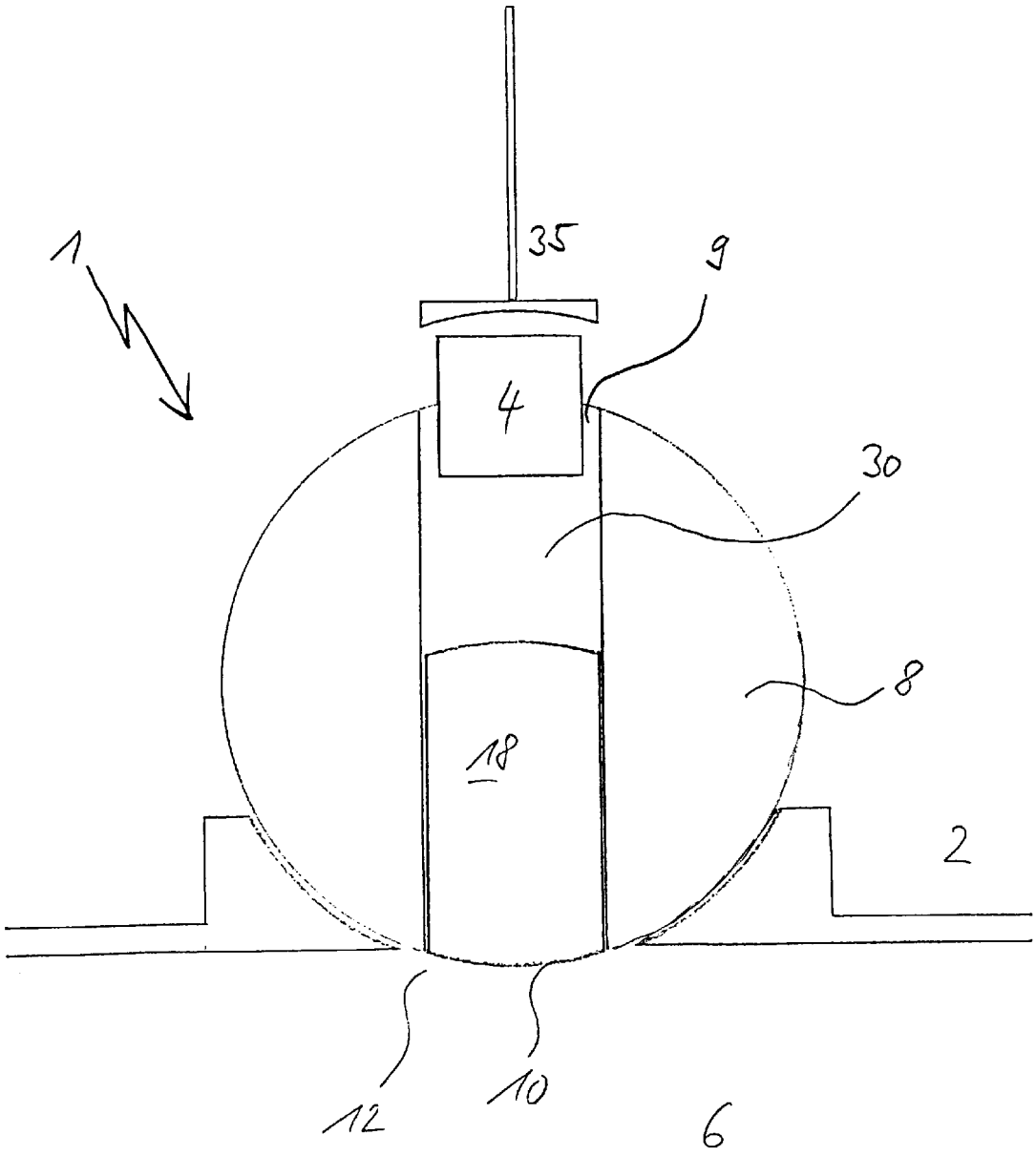
FIGS. 4 and 5 show a section through the goods transfer station according to FIG. 2 during the operation of introducing an article.

As is illustrated in FIG. 4, a pusher 35 pushes the article 4 into the conveying space 30. Alternatively, the piston element 18 may be connected to conveying belts 29 and driven by the latter. It is possible, for example, for the conveying belts 29 to be integrated in the walls of the transfer-station channel and, at the same time, to assist the introduction and discharging operations. When the article 4 is pushed in, the piston element 18 moves in the direction of the center of rotation and gradually releases the conveying space 30. In this case, the piston element 18 is located in the standby position on the opposite side of the rotary body, the conveying space 31 initially being free.

Figure 2:
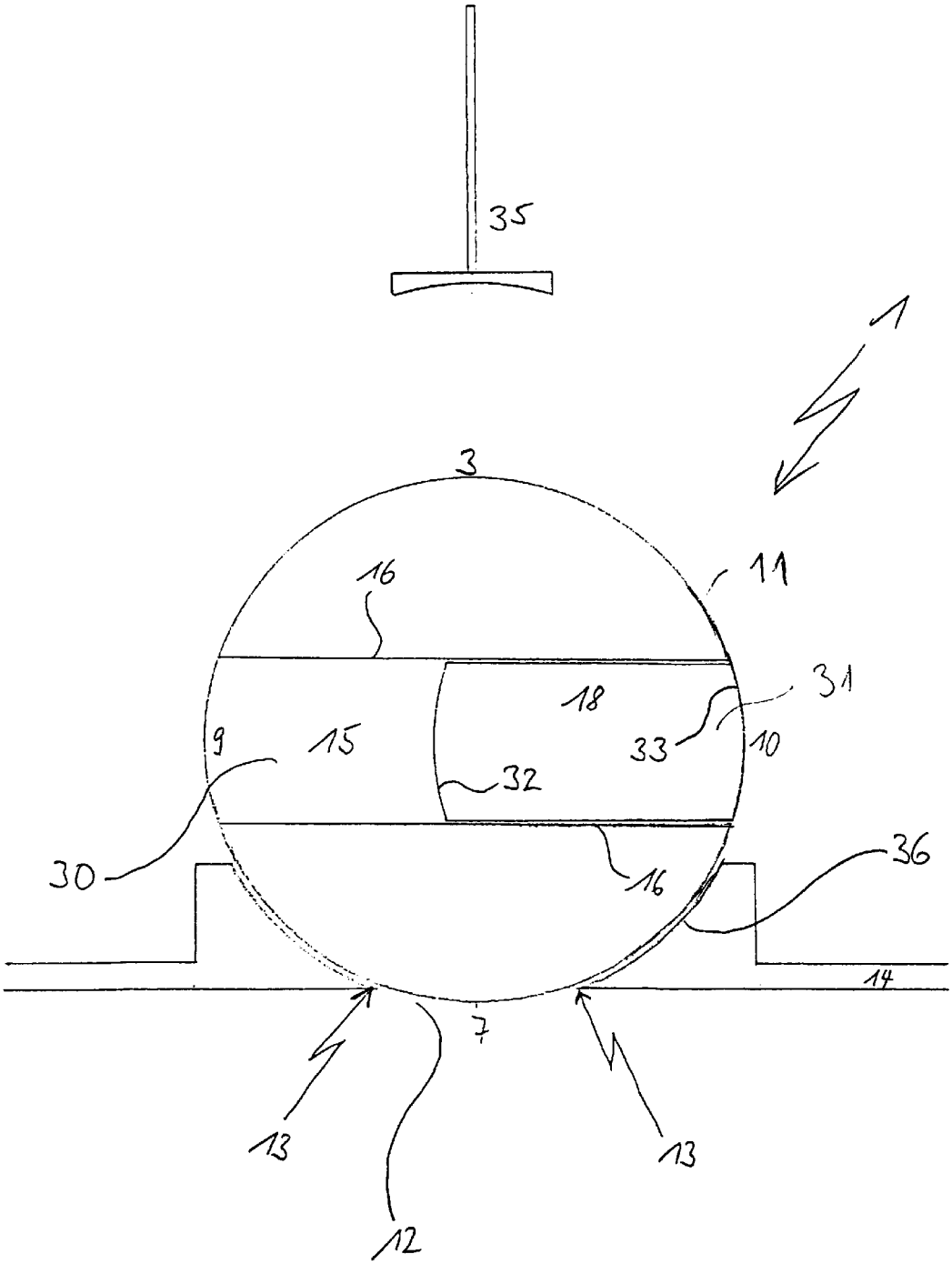
FIG. 2 shows a section through a goods transfer station with two rotatable conveying spaces, in the rest position.
Figure 5:
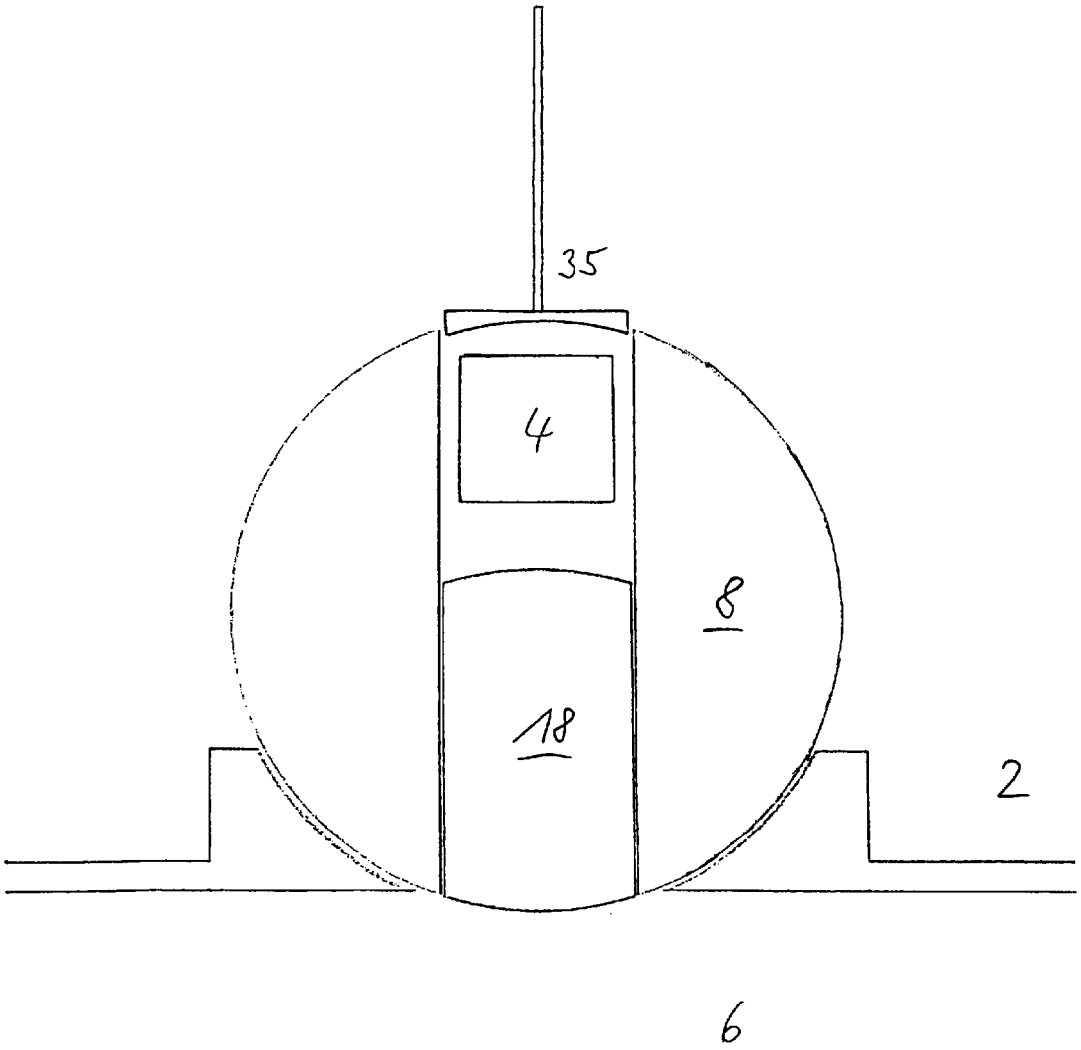
Figure 6:
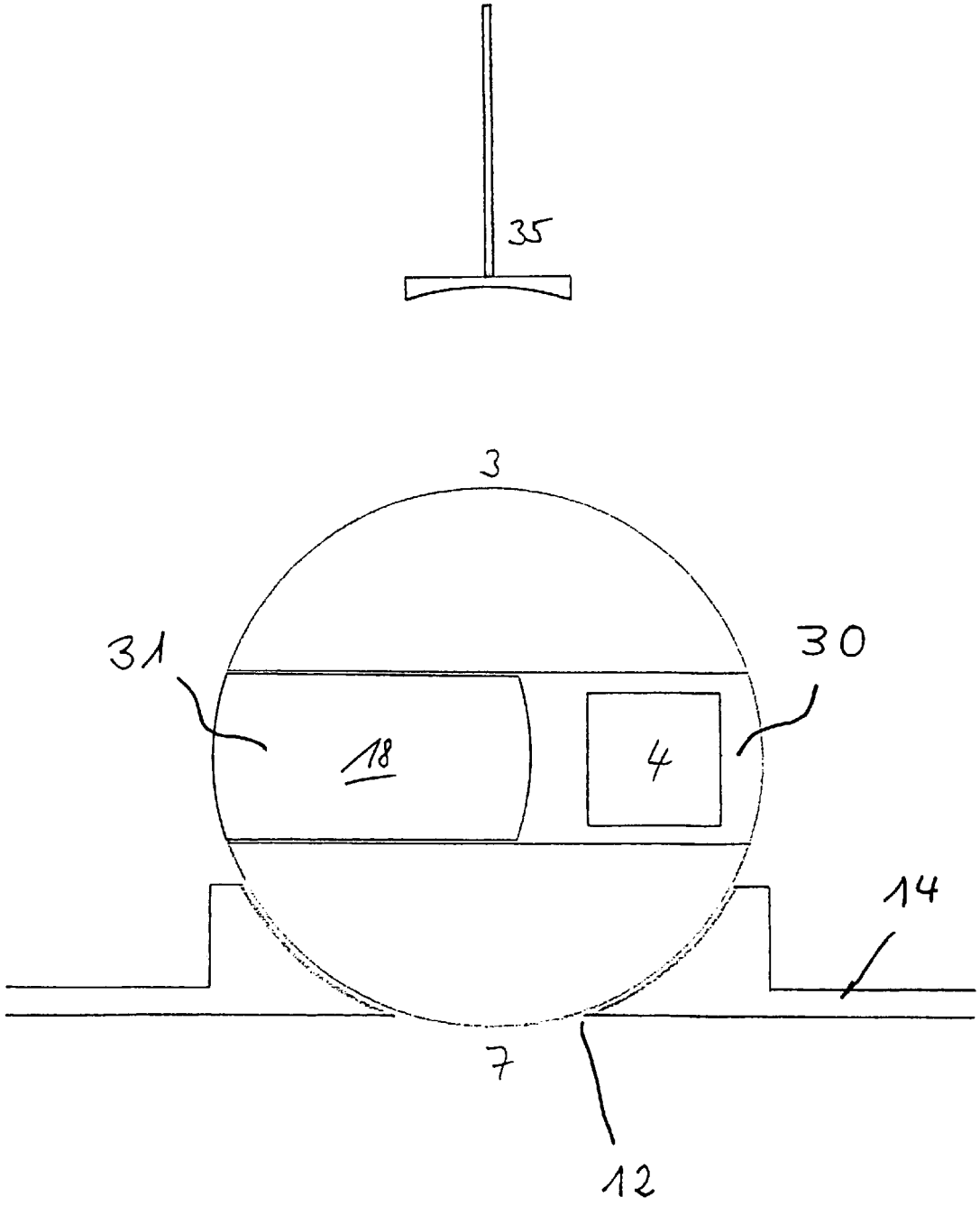
FIG. 6 shows a section through the goods transfer station according to FIG. 2 during rotation into the unloading position.
Figure 7:
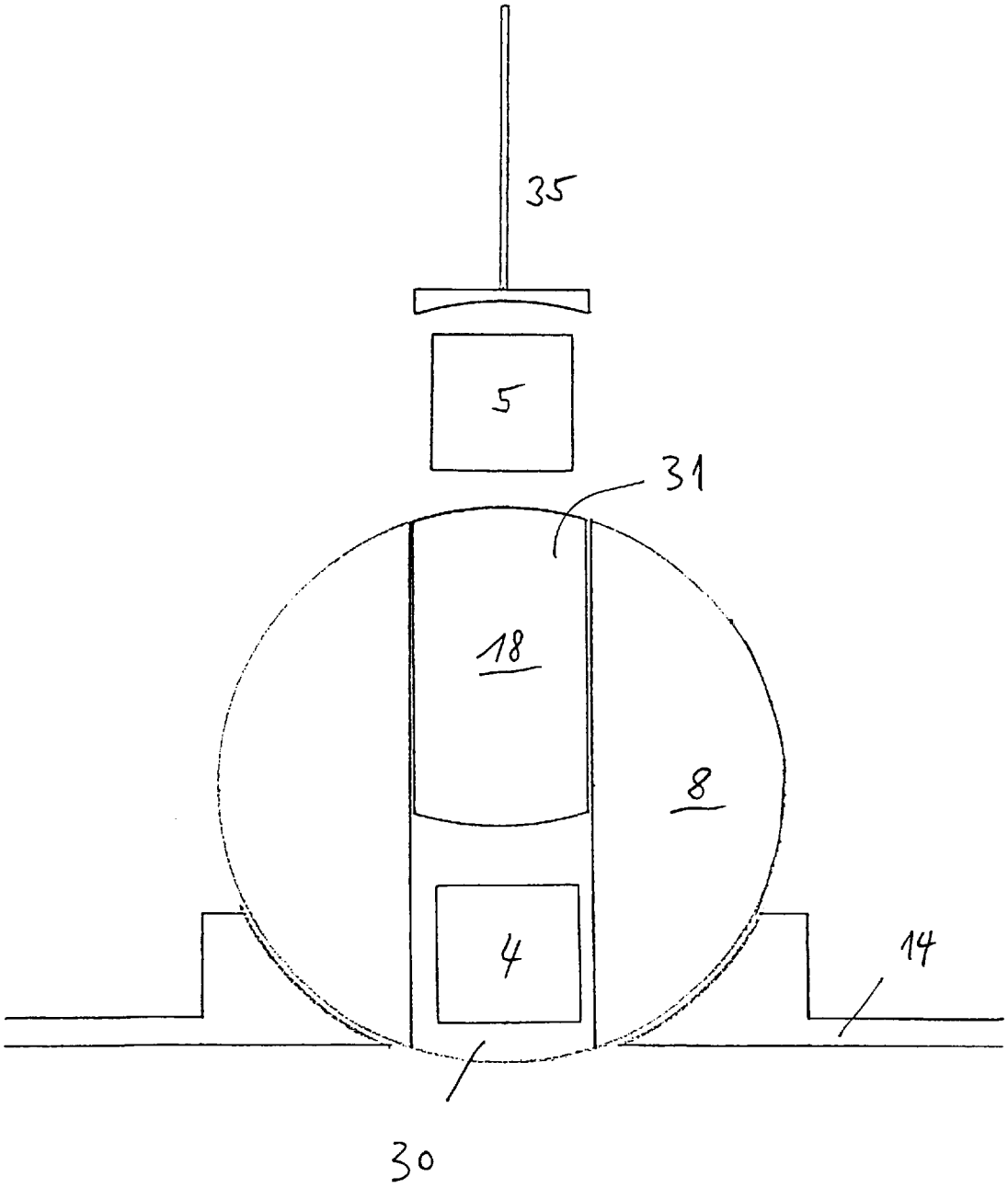
FIG. 7 shows a section through the goods transfer station according to FIG. 2 during the operation of discharging an article.
Figure 8:
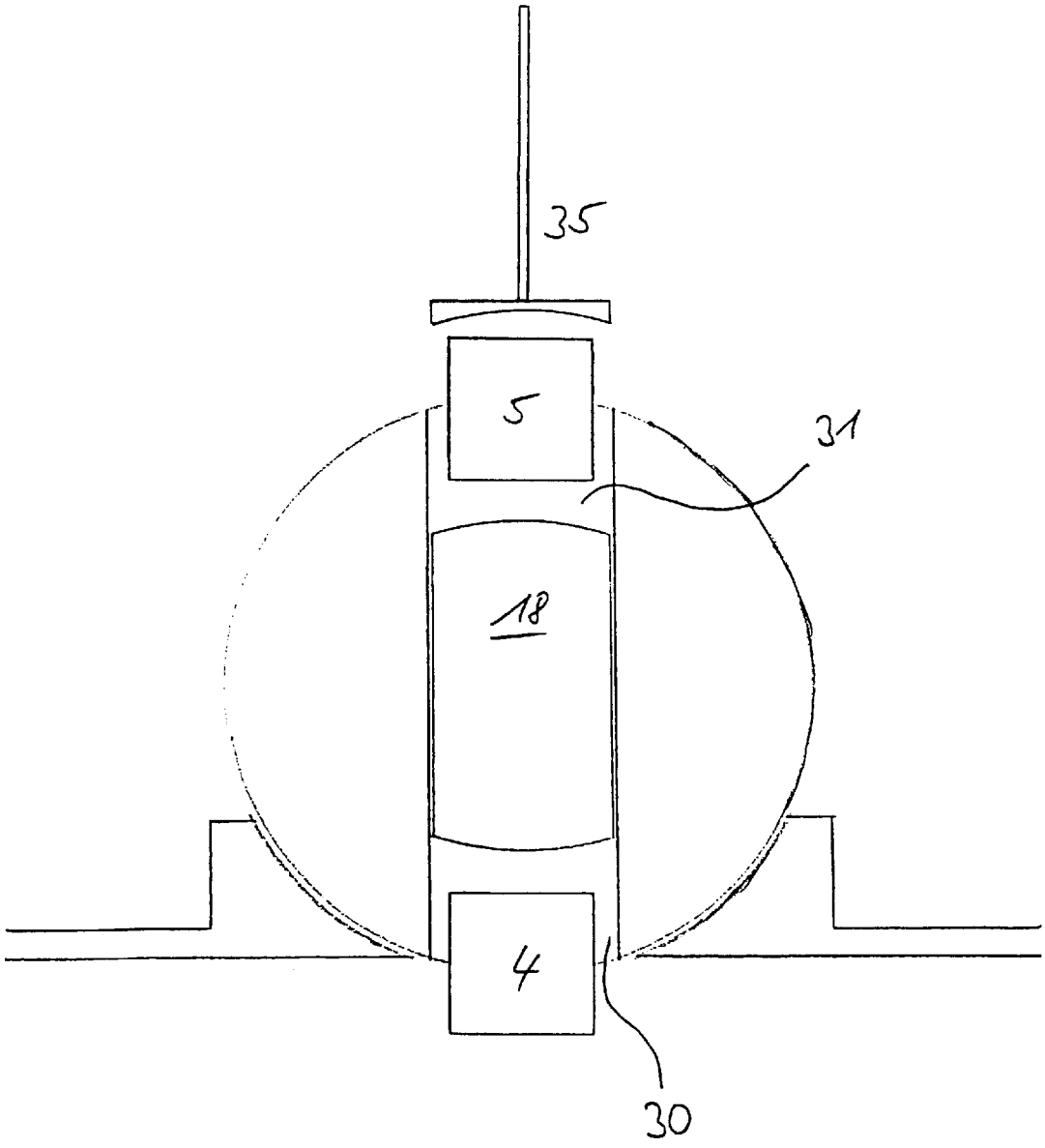
FIGS. 8 and 9 show a section through a goods transfer station during the simultaneous operations of discharging and introducing an article.
Figure 9:
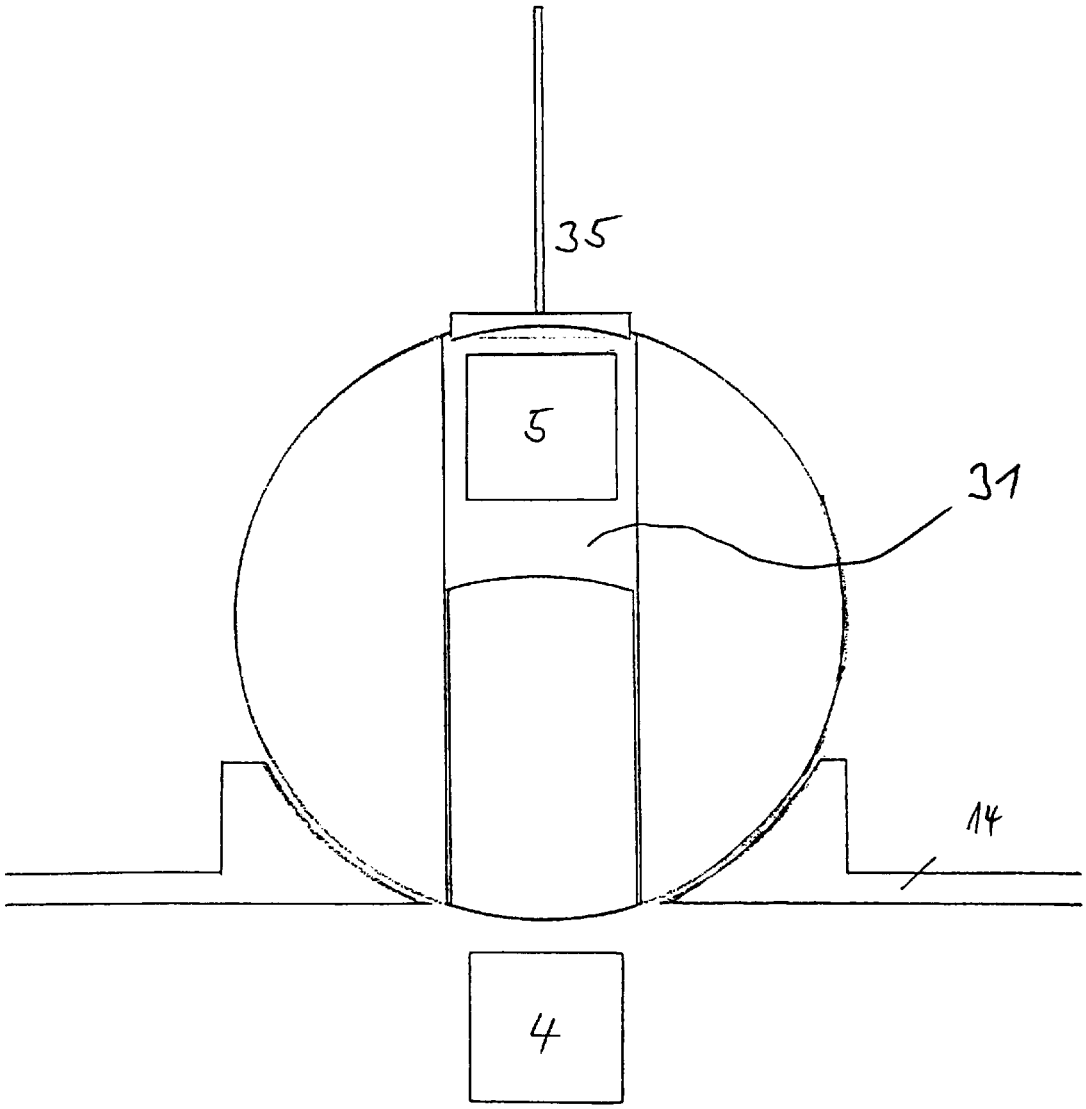

As soon as the introduction operation has been completed, as is illustrated in FIG. 5, the rotary body 8 is rotated, with the result that the conveying space 30 passes, via the intermediate position illustrated in FIG. 6, to the delivery window 12 (FIG. 7). If this position of the rotary body 8 has been reached, the piston element 18 is moved through the transfer-station channel 15 to the other side. The article or articles 4 in the relevant conveying space 30 is/are discharged and the opening 9 of the conveying space 30 is closed. At the same time, it is possible, in the other conveying space 31, for the next goods 5' which are to be discharged already to be moved into the transfer-station channel 15 (FIGS. 8 and 9). If no further goods are to be discharged, the rotary body 8 can be rotated into a rest position, with the result that the lateral surface of the rotary body blocks the delivery window 12 (FIG. 2).

The conveying spaces, rather than necessarily being formed by a continuous transfer-station channel, may also be realized by individual cutouts in the rotary body, which need not be connected to one another, or by cross-over channels. It is also possible for three or more conveying spaces to be arranged along the circumference of the rotary body. More than two conveying spaces allow an increase in the cycle rate and the discharging variants.

Figure 10:
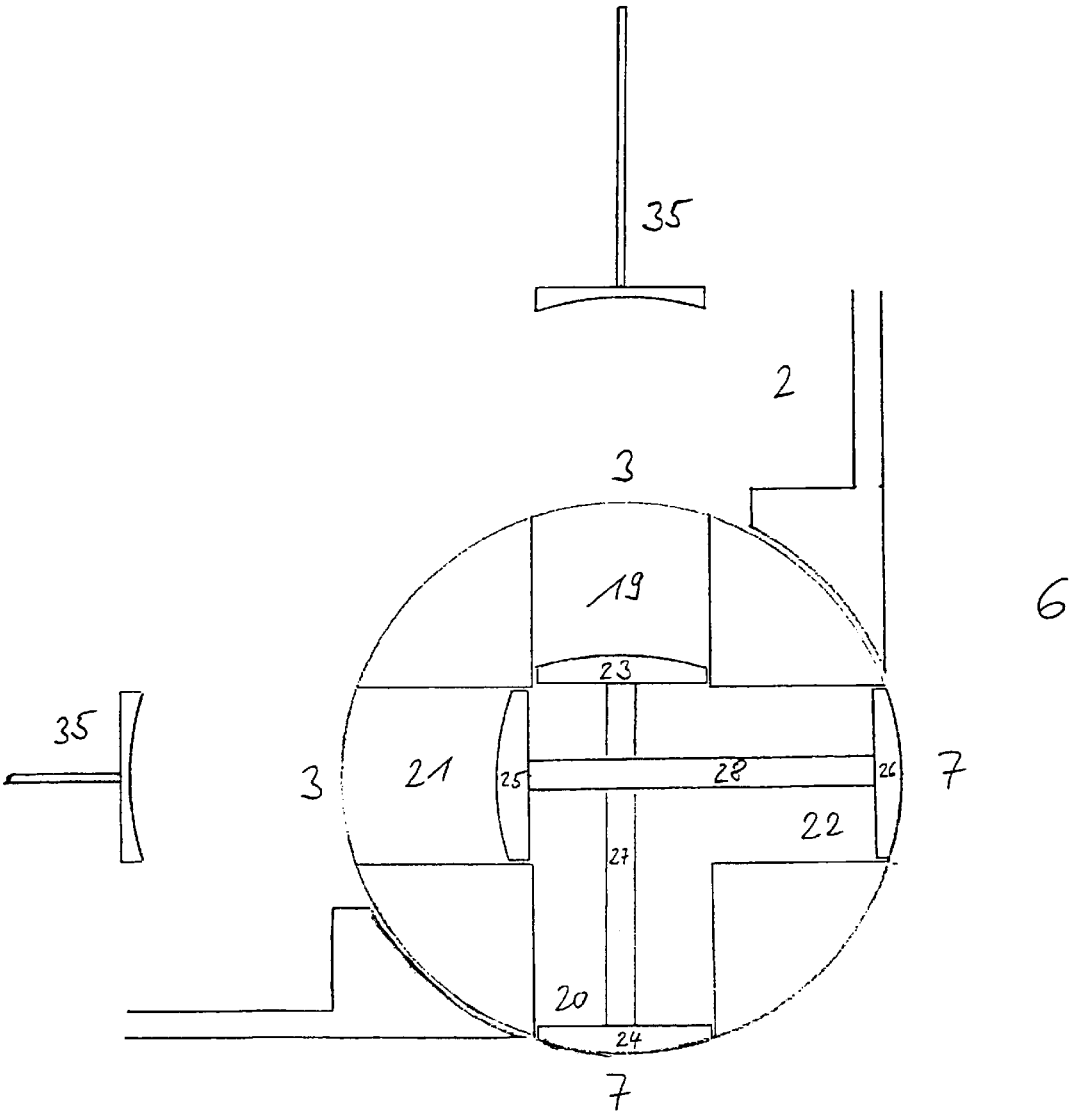
FIG. 10 shows a section through a goods transfer station with four conveying spaces.

FIG. 10 shows an example of a goods transfer station with four conveying spaces 19, 20, 21, 22. The closing elements 23, 24, 25, 26 either close the conveying spaces 19, 20, 21, 22 in the region of the lateral surface of the rotary body 8 or form the rear side of the conveying space, directed toward the center of rotation. It is thus possible, depending on the position of the closing elements 23, 24, 25, 26, for articles to pass into a conveying space 19, 20, 21, 22 in each case, but not to move further into the rotary body. The closing elements 23, 24, 25, 26 of mutually opposite conveying spaces are preferably connected to one another, e.g., by rods 27, 28, and are moved in pairs by the same drive. However, it is also possible for the closing elements 23, 24, 25, 26 to be configured such that they can be moved independently of one another. It is also conceivable to have a plurality of unloading positions (FIG. 10). A change in direction between loading and unloading may also be realized.

In a further embodiment, the rotary body is of annular configuration and a stationary closing element is arranged in its center, this closing element being capable of accessing each of the conveying spaces moved into the unloading position. Finally, it is also possible for the conveying spaces to be arranged in a row one beside the other and to be displaced linearly parallel to the delivery window. In this case, the conveying spaces preferably have two openings, of which one serves for loading purposes and the other serves for unloading purposes. It is also possible for the goods transfer station according to the invention to have a plurality of different loading positions, in order for the cycle to be increased further.

The advantages of the goods transfer station according to the invention are the smaller amount of time required for each introduction and discharging operation and the possibility of executing a plurality of introduction and discharging operations at the same time. The closing element serves, at the same time, as a front door which secures the conveying space against someone reaching in from the outside. It is possible to dispense with a structurally and functionally complex separate element. Furthermore, it is only necessary for the conveying mechanism serving for the introduction operation to move goods over small distances, in particular only to push them into the conveying space. It is thus possible to select a straightforward and simple design; the short distances allow a higher cycle rate. The goods transfer station according to the invention has a high level of operational reliability since the delivery opening is closed by the closing element before the rotary body rotates. The risk of getting something trapped is thus reduced.

While the invention has been described with reference to exemplary embodiments thereof, it is to be understood that the invention is not limited to the disclosed embodiments or constructions. To the contrary, the invention is intended to cover various modifications and equivalent arrangements. In addition, while the various elements of the embodiments are shown in various combinations and configurations, which are exemplary, other combinations and configurations, including more, less or a single element, are also within the spirit and scope of the invention.

What is claimed is:

1. A goods transfer station for discharging articles, comprising:

at least one partition wall with at least one delivery window, a rotatable rotary body having an axis and a lateral surface area which is continuous except at at least one opening, and at least one linear transfer channel arranged in said rotary body, said transfer channel comprising at least one conveying space arranged in said rotary body and at least one closing element, wherein the at least one conveying space is closed except for said at least one opening, through which an article can be discharged from the conveying space, the at least one conveying space can be moved between at least one unloading position and at least one loading position by rotation of the rotary body, the at least one opening is located in the delivery window in the unloading position, the at least one opening can be closed by the closing element at least in the unloading position, the transfer channel comprises at least one piston element having a side directed toward the opening, the side acting as the closing element, the at least one piston element is arranged linearly movable in the transfer channel in a plane perpendicular to the axis of the rotary body, the side of the at least one piston element, which acts as the closing element, has a curvature adapted to a shape of the rotary body in order to close the opening in the lateral surface of the rotary body after discharging the article from the conveying space and before and while rotating the opening away from the unloading position.

2. The goods transfer station as claimed in claim 1, wherein by moving said piston element, the volume of the at least one conveying space is decreased while the volume of at least one potentially further conveying space is increased, and vice versa.

3. The goods transfer station as claimed in claim 1, wherein, at most with the exception of an opening, the conveying space is closed in the unloading position and prior to the discharging operation, wherein the article can be discharged from the conveying space through said opening, and the closing element forms a side of the conveying space which is located opposite the opening at least prior to the discharging operation, and closes the opening once the article has been discharged and before the opening has been moved away from the delivery window.

4. The goods transfer station as claimed in claim 1, wherein the opening serves for introducing at least one article into the conveying space and for discharging the at least one article from the conveying space.

5. The goods transfer station as claimed in claim 1, wherein the conveying space is arranged in the rotary body which can be rotated about an axis by means of a rotary drive.

6. The goods transfer station as claimed in claim 1, further comprising at least two conveying spaces, which are formed by the ends of a transfer-station channel arranged in the rotary body.

7. The goods transfer station as claimed in claim 6, wherein the closing elements are formed by two sides of a piston element which are arranged in a movable manner in the transfer-station channel.

8. The goods transfer station as claimed in claim 7, wherein the piston element interacts with a drive unit which is arranged in the transfer-station channel and by means of which the piston element can be moved linearly in a direction of the transfer-station channel.

9. The goods transfer station as claimed in claim 1, wherein the closing element is capable of closing the opening of the conveying space to preclude access into the conveying space from outside.

10. The goods transfer station as claimed in claim 1, further comprising in a region of the loading position at least one conveying element for conveying the article into the conveying space.

11. The goods transfer station as claimed in claim 5, wherein the region of the delivery window which is directed toward an interior of the goods transfer station has protective walls.

12. The goods transfer station as claimed in claim 1, wherein a base of the conveying space is equipped with a conveying belt.

13. A process for operating a goods transfer station as claimed in claim 1, with the following steps:

positioning at least one of the at least one conveying space in a region of a loading position;

loading said conveying space with at least one article in the loading position;

rotating the rotary body until the conveying space is positioned in the unloading position wherein the opening is moved to the delivery window;

discharging the at least one article from the conveying space closing the opening in the lateral surface by moving the closing element in the piston direction substantially parallel to the article direction of discharging the article out of the conveying space; and;

rotating the rotary body such that the opening in the conveying space is moved away from the delivery window while the opening in the lateral surface is still closed by the closing element.

14. The process as claimed in claim 13, wherein two conveying spaces are provided and are moved synchronously.

15. The process as claimed in claim 14, wherein the closing elements assigned to the conveying spaces are moved synchronously.

16. The goods transfer station as claimed in claim 5, wherein the axis on which the conveying space can be rotated about is a vertical axis.

17. The goods transfer station as claimed in claim 9, wherein the closing element has a curvature adapted to a shape of the opening.

18. The goods transfer station, as claimed in claim 11, wherein the protective walls have a shape adapted precisely to the rotary body.

19. The process as claimed in claim 13, wherein, said transfer channel comprises a pair of conveying spaces; and wherein by moving the piston element, the volume of one of the conveying spaces of said pair is decreased while the volume of the other conveying space of said pair is increased.

20. The process as claimed in claim 19, wherein one of the conveying spaces of said pair is loaded while the other conveying space of said pair is unloaded.

21. The process as claimed in claim 1, wherein the at least one article is discharged from the conveying space while moving the closing element toward the opening in the lateral surface.

22. The goods transfer station as claimed in claim 1, further comprising;

at least two conveying spaces arranged in the rotary body, at least two corresponding openings in the lateral surface, and at least two closing elements for closing the respective opening, wherein a first conveying space can be moved away from the delivery window with the opening closed by the respective closing element, while a second conveying space is moved toward the delivery window.

23. The goods transfer station as claimed in claim 1, wherein the rotary body and the closing element are moved independently of one another.

* * * * *